US006516962B1

(12) United States Patent
Irsch et al.

(10) Patent No.: US 6,516,962 B1
(45) Date of Patent: Feb. 11, 2003

(54) TELESCOPIC BOOM FOR CRANES

(75) Inventors: Michael Irsch, Lebach (DE); Jens Fery, Endorf (DE)

(73) Assignee: Atecs Mannesmann AG, Düsseldorf (DE)

( * ) Notice: Subject to any disclaimer, the term of this patent is extended or adjusted under 35 U.S.C. 154(b) by 63 days.

(21) Appl. No.: 09/680,691

(22) Filed: Oct. 6, 2000

(30) Foreign Application Priority Data

Oct. 6, 1999 (DE) ..... 199 48 830

(51) Int. Cl.[7] ..... B66C 23/04
(52) U.S. Cl. ..... 212/348; 212/347
(58) Field of Search ..... 212/230, 264, 212/348, 349, 350, 347; 52/118

(56) References Cited

U.S. PATENT DOCUMENTS

| | | | | | |
|---|---|---|---|---|---|
| 3,748,807 | A | * | 7/1973 | Sterner | 52/632 |
| 3,958,377 | A | * | 5/1976 | Milner | 52/118 |
| 4,003,168 | A | * | 1/1977 | Brady | 52/118 |
| 4,016,688 | A | * | 4/1977 | Tiffin et al. | 52/118 |
| 4,168,008 | A | * | 9/1979 | Granryd | 212/144 |
| 4,337,601 | A | * | 7/1982 | Vaerk et al. | 52/118 |

FOREIGN PATENT DOCUMENTS

| | | | |
|---|---|---|---|
| DE | 3713152 | * | 4/1988 |
| DE | 197 11 975 | A1 | 9/1998 |
| DE | 198 29 829 | A1 | 1/2000 |
| EP | 0 117 774 | A1 | 9/1984 |
| EP | 922664 | * | 6/1999 |
| EP | 968955 | * | 7/1999 |
| WO | 91/01387 | * | 2/1991 |

OTHER PUBLICATIONS

Dubbel I 1963, pp. 353–355, Festigkeitslehre—Biegung.

* cited by examiner

*Primary Examiner*—Thomas J. Brahan
(74) *Attorney, Agent, or Firm*—Henry M. Feiereisen

(57) ABSTRACT

A telescopic boom for crane, in particular mobile cranes, includes a base section and a plurality of boom sections received in the base section and telescopically extendible and retractable. The base section and the boom sections are each made of a profile comprised of an upper shell and a lower shell which are joined together at their confronting walls, with the upper shell having a nominal wall thickness which is equal or smaller than a nominal wall thickness of the lower shell. At least one portion of the upper and lower shells includes, as viewed in cross section, two outer thin metal sheets which are placed in spaced-apart relationship to define an intermediate space therebetween.

14 Claims, 4 Drawing Sheets

TELESCOPIC BOOM FOR CRANES

CROSS-REFERENCES TO RELATED APPLICATIONS

This application claims the priority of German Patent Application Serial No. 199 48 830.4, filed Oct. 6, 1999.

BACKGROUND OF THE INVENTION

The present invention relates, in general, to a telescopic boom for cranes, especially mobile cranes.

German Pat. No. DE 197 11 975 A1 describes a telescopic boom of a type including a main boom having a base section and a plurality of boom sections received in the main boom and telescopically extendible and retractable. The base section and the boom sections are each made of a profile having an upper shell and a lower shell which are welded together at their confronting walls. The upper shell has a nominal wall thickness which is typically smaller than a nominal wall thickness of the lower shell, although there are other designs which propose to fabricate the upper and lower shells of same nominal wall thickness.

In the description, the term "nominal wall thickness" has been selected to make clear that fluctuations of the wall thickness in transverse and longitudinal directions during fabrication should be disregarded. The nominal wall thickness of both shells should thus be considered constant in transverse and longitudinal directions, whereby the zone that is subject to greatest stress determines the magnitude of the wall thickness. The way the wall thickness for this zone of greatest stress is dimensioned establishes also to a substantial degree the weight of the boom. A further parameter is the desired length of the boom by which the required number of telescoping boom sections is determined. Road traffic regulations impose a maximum permissible axle load so that as a result of the weight of the boom the limits of the load-carrying capability and hoisting height are very quickly reached. Dismantling of the entire boom and separate transport of the dismantled boom may be one of the options to solve the stated problem. Assembly and disassembly of the boom is, however, complex and labor-intensive and can be further compounded by conditions at the job site. Moreover, it requires provisions for an additional transport.

SUMMARY OF THE INVENTION

It is thus an object of the present invention to provide an improved telescopic boom for cranes, obviating the aforestated drawbacks.

In particular, it is an object of the present invention to provide an improved telescopic boom for cranes which permits a higher load-carrying capability at same limiting factors for the hoisting height and maximum permissible axle load.

These objects, and others which will become apparent hereinafter, are attained in accordance with the present invention by providing a telescopic boom having a base section and a plurality of boom sections received in the base section and telescopically extendible and retractable, wherein the base section and the boom sections are each made of a profile comprised of an upper shell and a lower shell which are joined together at their confronting walls, with the upper shell having a nominal wall thickness which is equal or smaller than a nominal wall thickness of the lower shell, wherein at least one portion of one of the upper and lower shells includes, as viewed in cross section, two outer thin metal sheets placed in spaced-apart relationship to define an intermediate space therebetween.

Suitably, the intermediate space may be filled, partially or entirely, with filler material. For strength and weight reasons, an appropriate filler material is metal foam, preferably aluminum metal foam. Such a sandwich structure has the advantage that the own weight of the boom can be drastically reduced, without compromising the stiffness and buckling strength. A somewhat more complex fabrication of the boom is more than made up by the increased load-carrying capability. The advantages of the sandwich structure can be further enhanced, when the shell has in transverse direction a nominal wall thickness that is commensurate with the load. In this way, those zones that are subject to greatest stress can be designed with the required wall thickness whereas zones that are subject to less stress may have a thinner wall thickness.

According to another feature of the present invention, areas of the sandwich structure that are exposed to great local force introduction, e.g. bolting area, should be provided with a reinforcement. For example, the intermediate space between the metal sheets may be filled with solid material, or outer metal sheets may have a greater wall thickness.

Of course, the general concept described herein for making the base section and the telescoping boom sections of sandwich structure, is equally applicable to other elements of the boom. For example, box-like extensions which may be mounted to the boom head of the fly section can also be fabricated by a sandwich structure according to the present invention.

The weight distribution in the head area of booms is of particular relevance and, to a large extent, governs the exploitable load-carrying capability. In this context, it should be noted that the application of the sandwich structure is independent of the cross sectional configuration of the boom sections, i.e. it is secondary whether the boom section is rectangular, ovaloid, oval or round. The concepts of the sandwich structure is also applicable for latticed tower cranes. Critical hereby are the chords that are subject to buckling loads. A filling of the chords with metal foam results in a significant reduction of the wall thickness of the chords and thus in a weight reduction.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
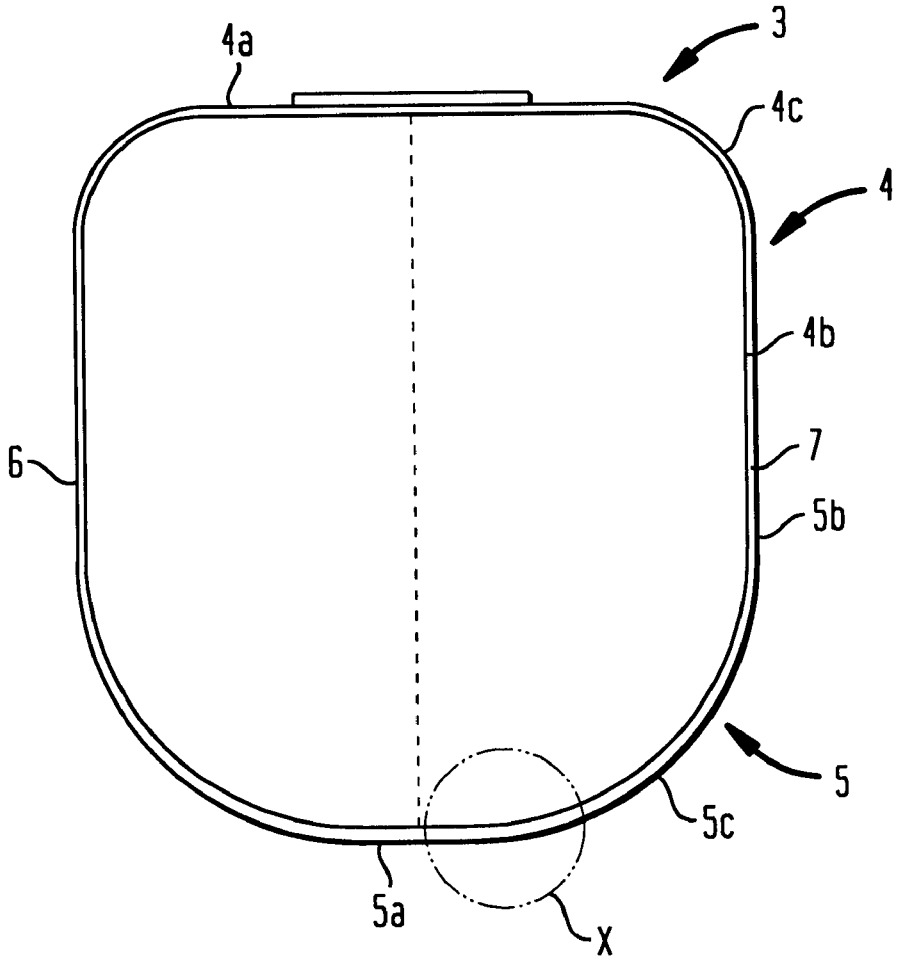
FIG. 1 is a cross section of a boom section of a telescopic boom according to the present invention.

Throughout all the Figures, same or corresponding elements are generally indicated by same reference numerals.

Figure 3:
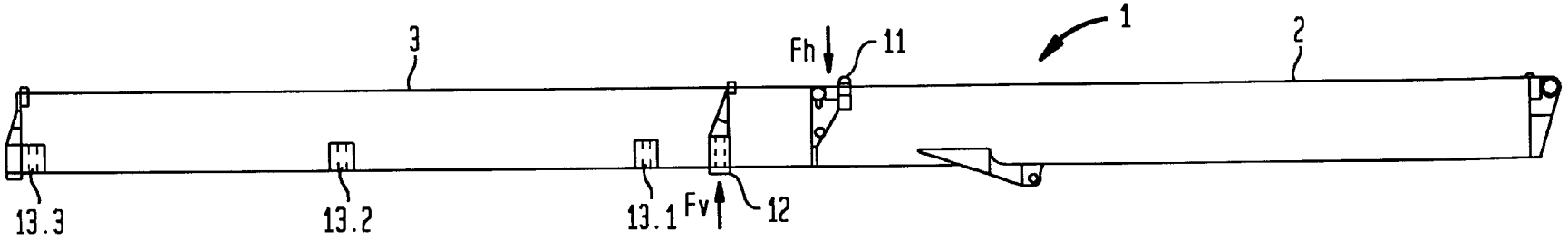
FIG. 3 is a longitudinal view of zones of the boom section that are subjected locally to high force introduction.
Figure 5:
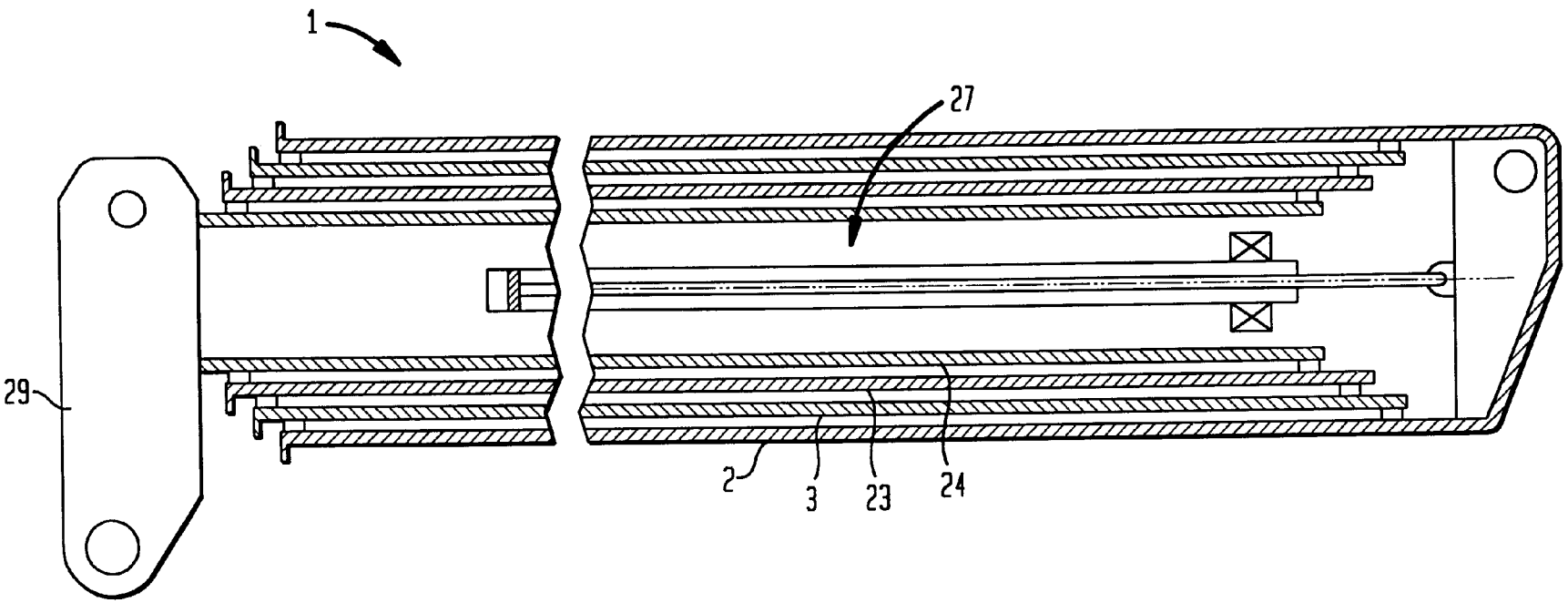
FIG. 5 is a schematic longitudinal section of a telescopic boom, having incorporated the present invention.

Turning now to the drawing, and in particular to FIG. 1, there is shown a cross section of a boom section, generally designated by reference numeral 3 and forming part of a telescopic boom 1 (FIG. 3). In general, as shown in FIG. 5, telescopic booms have a main boom 1 made up of a series of sections 3, 23, 24 that are nested within one another. The largest section at the bottom of the boom is the base section 2 and the smallest section at the top of the boom is the fly section 24 which is connected to the head 29 of the boom. A conventional telescoping mechanism 27 is used to move the boom sections. Between the boom section and the fly section may be one or more further boom sections. In addition, the boom may be extended by a jib that is mounted at the boom tip. In the following description, the term "boom section" is used to refer, in general, to any one of the sections of the booms, i.e. base section, fly section, or intermediate section, or jib section.

Figure 7A:
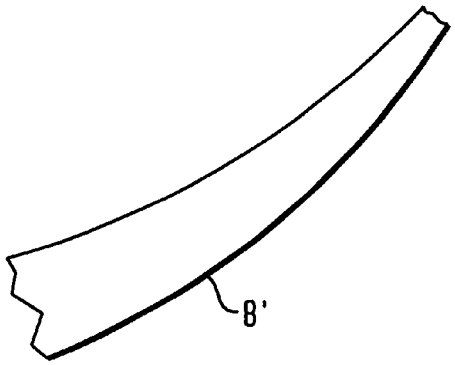
FIG. 7*a* is a schematic cutaway view, on an enlarged scale, of a portion of the lower shell with continuously decreasing wall thickness.
Figure 7B:
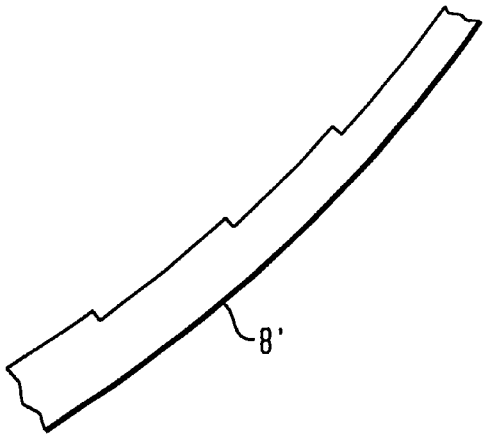
FIG. 7*b* is a schematic cutaway view, on an enlarged scale, of a portion of the lower shell with discontinuously decreasing wall thickness.

The boom section 3 is made of an upper approximately half-box shaped shell, generally designated by reference numeral 4 and a lower U-shaped shell generally designated by reference numeral 5. The upper shell 4 has a flat apex region 4*a* which connects to straight side walls 4*b* via curved transition portions 4*c*, whereas the lower shell 5 has a flat base or cross portion 5*a* which connects to straight side walls 5*b* via curved transition portions 5*c*. At confronting ends of the side walls 4*b*, 5*b*, the upper and lower shells 4, 5 are joined together along longitudinal welding seams 6, 7. Suitably, the lower shell 5 has a nominal wall thickness which decreases in width, continuously, as shown in FIG. 7*a*, or discontinuously, as shown in FIG. 7*b*, from the base 5*a* via the curved transition portions 5*c* to a minimum wall thickness in the side walls 5*b*.

Figure 2:
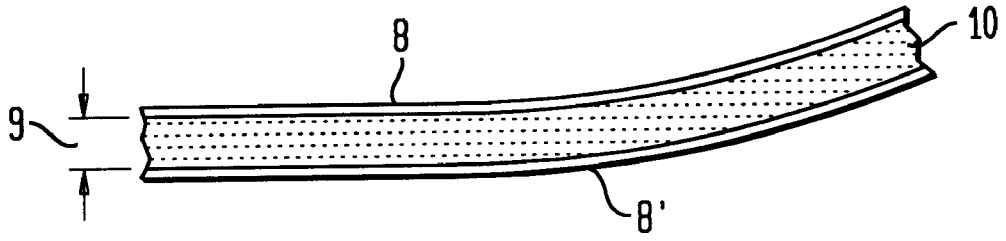
FIG. 2 is a cutaway view of a portion of the boom section, designated by in FIG. 1.

In FIG. 1, it is shown by way of example only that the lower shell 5 is made of sandwich structure, as will now be described in more detail with reference to FIG. 2. Of course, the principles described in the following description with respect to the lower shell 5 are generally applicable to the upper shell 4 as well.

Figure 6:
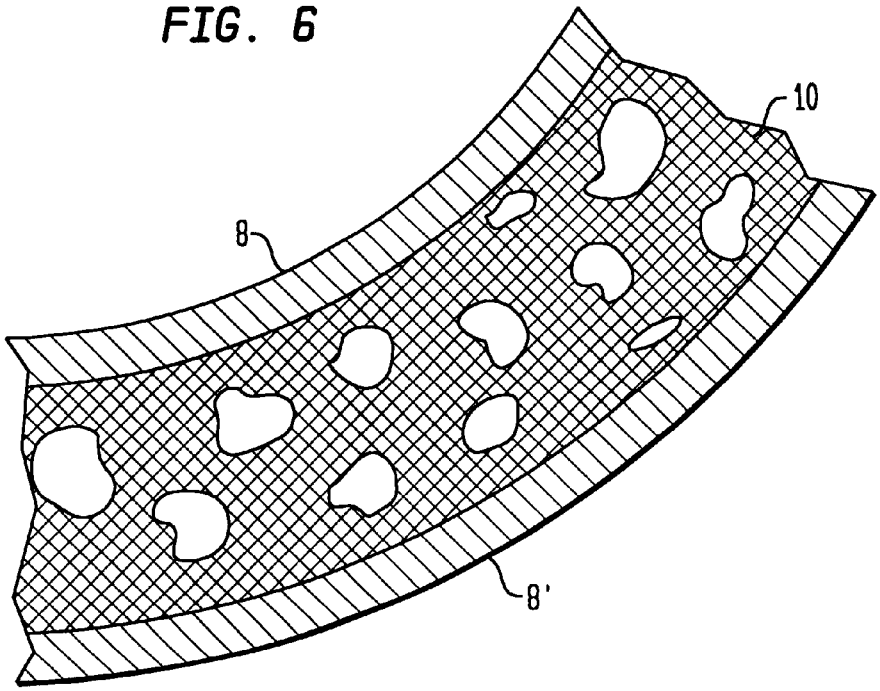
FIG. 6 is a detailed cutaway view, on an enlarged scale, of a portion of a lower shell of the boom section in sandwich structure with partially filled intermediate space.

The sandwich structure is comprised of two thin metal sheets 8, 8' in spaced-apart disposition at formation of an intermediate space 9, whereby, as shown, by way of example, in FIG. 6, the outer sheet 8' has a greater wall thickness than the inner sheet 8. The intermediate space 9 may be empty, or may also be partially or fully filled. FIG. 6 further shows, by way of example, the intermediate space 9 partially filled with a filler material, i.e. filler material having bubbles in between. Examples for suitable filler material include metal foam 10, preferably aluminum metal foam. In general, metal foam is a material in which a metal, e.g. aluminum, is heated with a gas-producing foaming agent so that bubbles of gas are dispersed throughout the finished metal foam product. As a consequence, the metal foam has a very low specific own weight. This fact in conjunction with the fact that the enclosing metal sheets 8, 8' have a slight wall thickness results in a flat unitary element in sandwich structure for the lower shell 5 that is overall lighter than a component made entirely of solid metal sheet.

Figure 4:
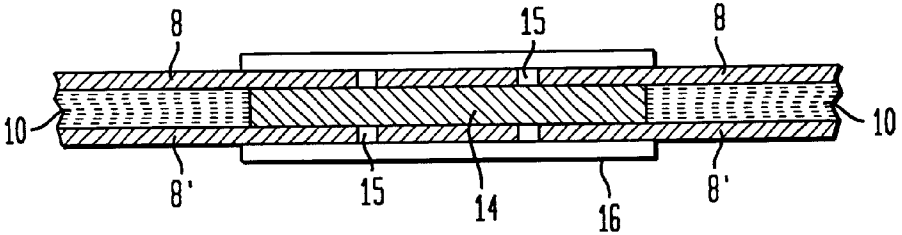
FIG. 4 is a longitudinal view of a variation of the boom section, having incorporated therein a reinforcement.

Turning now to FIG. 3, there is shown a longitudinal view of the telescopic boom 1 having a base section 2 and only one telescoping boom section 3. Of course, the telescopic boom may have several such telescoping boom sections. However, for sake of simplicity, FIG. 3 shows only one boom section whereby the areas that are subject, locally, to great force introduction are highlighted, such as the upper bearing area 11 (Fh) and the lower bearing area 12 (Fv), on the one hand, and the locking areas 13.1, 13.2, 13.3. As a result of the sandwich structure in accordance with the present invention, these areas can be reinforced in a manner shown in FIG. 4. In these areas that are subject to high stress, the filler material in the form of metal foam 10 is interrupted or removed, as the case may be, and replaced by a reinforcement piece 14 of solid material. Attachment of the reinforcement piece 14 is realized by welding along welding seams 15, 15'. Of course, it is also an option to leave the metal foam 10 in place and realize a reinforcement by increasing the wall thickness of the outer metal sheets 8, 8', as indicated by dotted line 16.

While the invention has been illustrated and described as embodied in a telescopic crane for cranes, it is not intended to be limited to the details shown since various modifications and structural changes may be made without departing in any way from the spirit of the present invention.

What is claimed as new and desired to be protected by Letters Patent is set forth in the appended claims:

1. A telescopic boom for crane, comprising a base section and a plurality of boom sections received in the base section and telescopically extendible and retractable, each of said base section and said boom sections being made of a profile comprised of an upper shell and a lower shell which are joined together at their confronting walls, said upper shell having a nominal wall thickness which is equal or smaller than a nominal wall thickness of the lower shell, only the lower shell being made of sandwich structure, wherein the lower shell includes, as viewed in cross section, two thin metal sheets placed in spaced-apart relationship to define an intermediate space therebetween, wherein the intermediate space is filled partially or entirely with a metal foam.

2. The telescopic boom of claim 1 wherein the metal foam is aluminum metal foam.

3. The telescopic boom of claim 1 wherein the lower shell has a base which is subject to stress and prone to buckle and which connects to a straight wall portion via a curved transition portion, said lower shell having a nominal wall thickness which decreases in width, continuously or discontinuously, from the base via the curved transition portion to a minimum wall thickness in the straight wall portion.

4. The telescopic boom of claim 3 wherein the lower shell has a U-shaped configuration and the base is horizontal.

5. The telescopic boom of claim 1, and further comprising a reinforcement for attachment to at least one of the upper and lower shells.

6. The telescopic boom of claim 5 wherein the reinforcement is a solid material filling the intermediate space.

7. The telescopic boom of claim 5 wherein an outer one of the two thin metal sheets has a greater thickness than an inner one of the metal sheets.

8. A boom section for a telescopic boom of a crane, comprising:

an upper shell; and a lower shell made of sandwich structure, said upper and lower shells being joined together to form an enclosed space, wherein the lower shell is made of two metal sheets placed in spaced-apart relationship to define an intermediate space therebetween, wherein the intermediate space is filled partially or entirely with a metal foam.

9. The boom section of claim 8 wherein the metal foam is aluminum metal foam.

10. The boom section of claim 8 wherein the at least one of the lower and upper shells has a cross portion which connects to a straight wall portion via a curved transition portion, said at least one of the lower and upper shells having a nominal wall thickness which decreases from the cross portion via the curved transition portion to a minimum wall thickness in the straight wall portion.

11. The boom section of claim 10 wherein the at least one of the lower and upper shells is the lower shell and has a U-shaped configuration with the cross portion extending horizontal.

12. The boom section of claim 8 wherein the lower shell has a nominal wall thickness which is greater than a nominal wall thickness of the upper shell.

13. The boom section of claim 8, and further comprising a reinforcement piece received in the intermediate space.

14. The boom section of claim 13, wherein the reinforcement piece is made of solid material.

* * * * *